United States Patent [19]

Carra

[11] Patent Number: 4,940,226

[45] Date of Patent: Jul. 10, 1990

[54] SIMULATED SKATING EXERCISING APPARATUS

[76] Inventor: Robert Carra, 8 Renee Rd., Syosset, N.Y. 11791

[21] Appl. No.: 398,929

[22] Filed: Aug. 28, 1989

[51] Int. Cl.[5] ..... A63B 21/00

[52] U.S. Cl. ..... 272/70; 434/253

[58] Field of Search ..... 272/70, 93, 97, 56.5 SS, 272/56.5, 105, 126, 134; 273/3 R, 3 A; 361/212; 434/253, 254

[56] References Cited

U.S. PATENT DOCUMENTS 2,842,365 7/1958 Kelley ..... 272/70

4,779,862 10/1988 Keppler ..... 272/70

FOREIGN PATENT DOCUMENTS 2041227 9/1980 United Kingdom ..... 272/56.5 R

*Primary Examiner*—Stephen R. Crow

[57] ABSTRACT

An ice skater's exercise device which unrolls from a compact storage condition into an elongated rectangular plastic body or strip having a low friction surface for performing alternating side-to-side sliding movements thereon between a cooperating pair of raised and concave shaped stops, wherein the terminal portion of each slide is in a slightly ascending path which assists in terminating the directional nature thereof and causing a reversal therein.

1 Claim, 2 Drawing Sheets

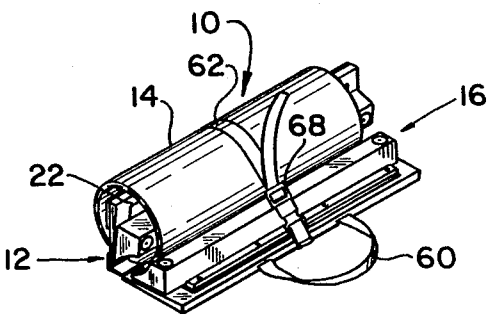
FIG.1
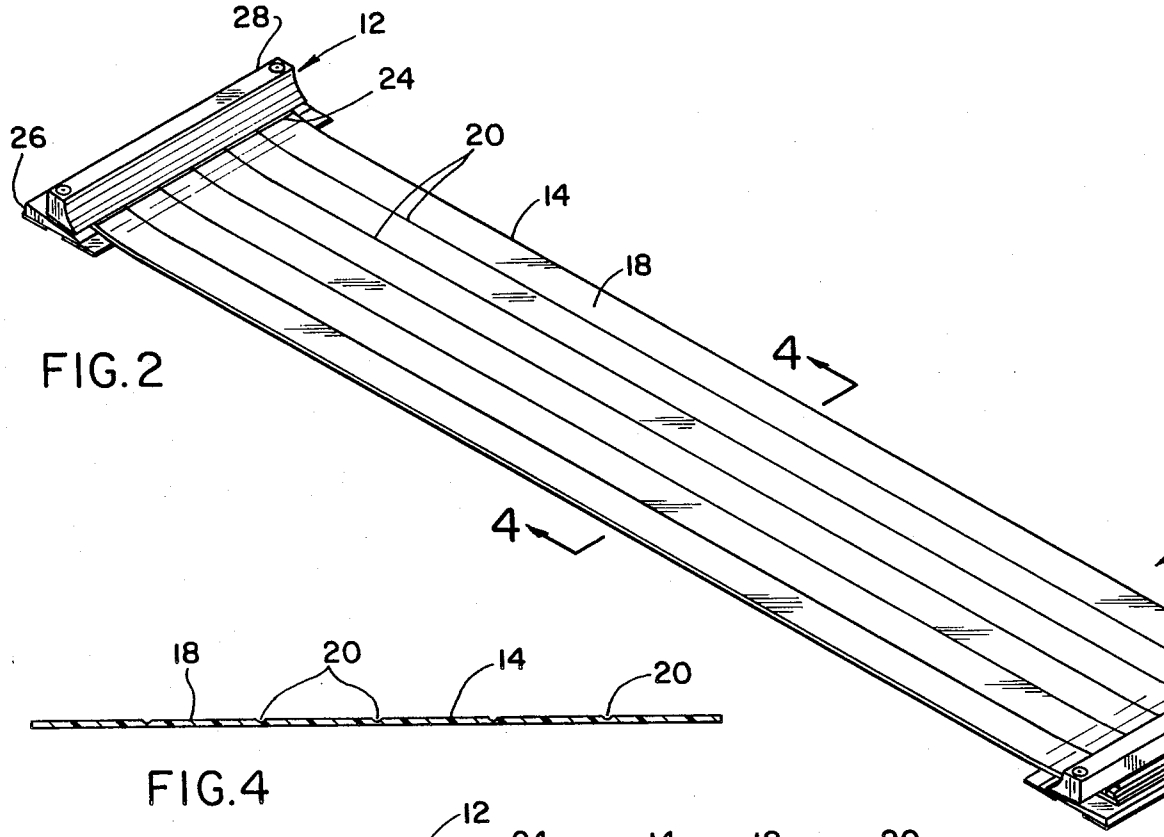
FIG.2
FIG.4
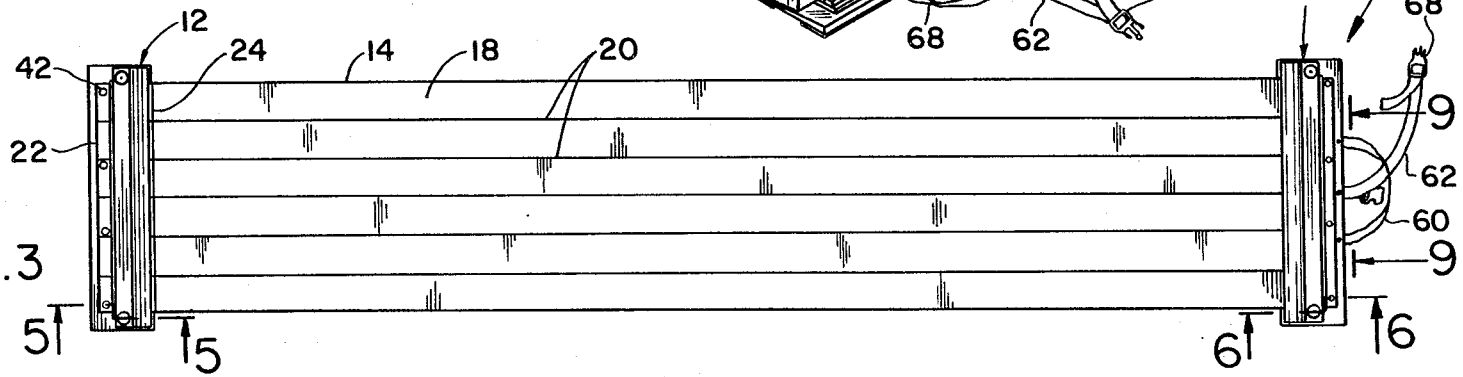
FIG.3

SIMULATED SKATING EXERCISING APPARATUS

The present invention relates generally to an exercise device in the specific form of a slideboard, and more particularly to an elongated body of plastic construction material on which side-to-side sliding exercise routines are performed in opposite directions lengthwise of the plastic body, and wherein there are improvements in the manner in which these movements are confined to this operative surface area.

In simulating ice skating for training and improving performance, an exercise routine contemplating side-to-side alternating movement on a surface with little or no friction is recommended by coaches and trainers. Presently available for this purpose is typically a rectangular board which merely presents the required slip surface on one side thereof and has blocks at opposite ends of this surface to assist the exerciser in reversing direction. The handling of this prior art board is cumbersome, because of its size, and contact against the blocks required for reversing direction often inadvertently results in foot injuries.

It is thus the object of the present invention to provide an ice-skate simulating exercise device overcoming the foregoing and other shortcomings of the prior art. More particularly, it is an object to replace the traditional board with an elongated strip of plastic which is rolled in helical turns upon itself to provide a compact storage and readily portable condition when not in use, and to use movement-confining blocks thereon which significantly obviate the possibility of injury upon contact, as well as providing other benefits heretofore not possessed by prior art practice slide boards.

The description of the invention which follows, together with the accompanying drawings should not be construed as limiting the invention to the examples shown and described, because those skilled in the art to which this invention appertains will be able to device other forms thereof within the ambit of the appended claims.

FIG. 1 is a prospective view of the elongated slideboard device of the present invention in its helically rolled condition appropriate for storage and transport.

FIG. 2 is a prospective view of the slideboard in its unrolled condition ready for use.

FIG. 3 is a top planned view of the slideboard showing further structural details.

FIG. 4 is an enlarged sectional view as taken along line 4—4 of FIG. 2.

Figure 5:
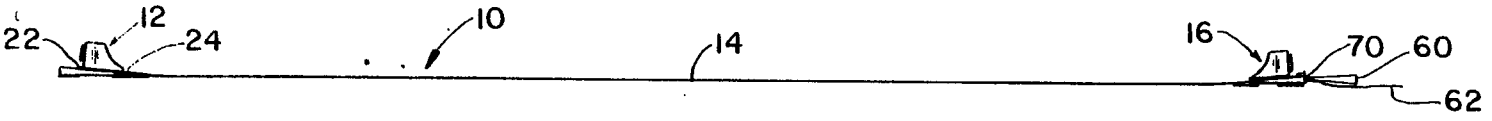
FIG. 5 is a front elevational view of the slideboard.

Reference is made to FIG. 1, in which the slideboard 10 is shown in helical terms or in its rolled up storage condition. Slideboard 10 as shown in FIG. 2 is comprised of a far side end assembly 12, a slide body 14, and an opposite side end assembly 16. Although the function and general appearance of the end assemblies 12 and 16 are substantially similar, there are distinct differences that will be pointed out as the description proceeds.

In the unrolled condition (FIG. 2), what was the inner end assembly in the rolled condition, is end assembly 12 that is shown to the far left and, of course, the outer end assembly 16 is to the right, with the slide body 14 there between.

In a preferred embodiment of the slideboard 10, slide body 14 is made of low coefficient of friction polypropylene plastic that is 0.070 inches thick, has a skating surface that has a length of 96 inches and a width of 18 inches. Thus, the primary construction material of device 10 is plastic and not wood or "board", even though it is commonly referred to as a skateboard or slideboard. As best seen in FIG. 4, the non-friction surface of body 14, denoted by the reference numeral 18, has a set of five linear grooves 20, dividing the slide body 14 into six 3 inch sections. At the far end 22 of the body 14, just inboard of end assembly 12 that assumes the inner rolled position, there is a transverse groove 24 which has the degree of flexure to serve as a "living hinge" and thus allows a small radius bend at the location 24, when the device 10 is rolled up. When in use, it is recommended that the upper surface 18 be treated with a silicone spray to enhance its low friction characteristics.

Figure 6:
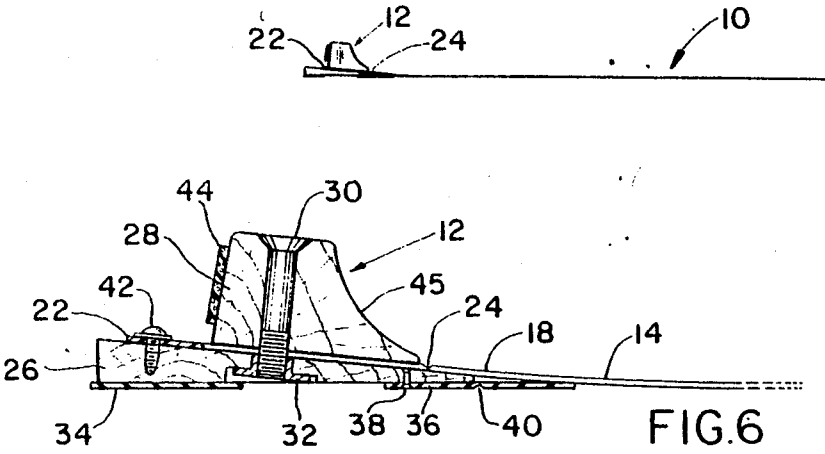
FIG. 6 is a partial sectional view as taken along line 5—5 of FIG. 3.

Inner end assembly 12 may best be understood with reference to FIGS. 5 and 6. As shown therein, base plate 26 is fastened to stop block 28 by adjacent flat head Allen machine screws 30, only one of which is visible in FIG. 6. Slide body 14 is advantageously clamped between block 28 and plate 26. Screws 30 engage flange nuts 32 which are positioned in a counterbore on the underside of base plate 26.

In practice, base plate 26 is made of hard wood and has a wedge shape cross section. To hold the position of the device 10 on a support surface, there is adhesively connected on the outer edge of the bottom surfae of base plate 26 a friction surface in the form of a rubber strip 34. A second rubber strip 36 is adhesively connected to the inner edge of plate 26 and is sized to extend in overlapping relation beyond block 26 to the body 14. Strip 36 optionally may also be held in place by riverts 38. A linear groove 40 provides stress relief along strip 36 when the slide board 10 is placed in its rolled mode or condition. Slide body 14 is permanently connected to base plate 26, at end 22, by four wide pan head wood screws 42.

Stop block 28, like base plate 26, is also made of hard wood and is profiled as seen in cross section in FIG. 6. The vertical surface thereof is fitted with an adhesively connected foam rubber strip 44. The opposite surface 45 of block 28 is concave as shown, and sharp edges are modified throughout into rounded corners. The concave curvature of surface 45 is a significant contribution of the present invention because it has been found to greatly reduce injury heretofore occasioned by contact against the stop component by the user incident to reversing direction, undoubtedly because the foot of the user upon making contact "rides up" the concave curvature and this arrests or slows down the sliding movement using, in effect, the weight of the exerciser. This is in sharp contrast to the prior at where the directional sliding movement to undergo reversal was achieved mainly by impact against the stop, and this impact often caused injury.

Figure 7:
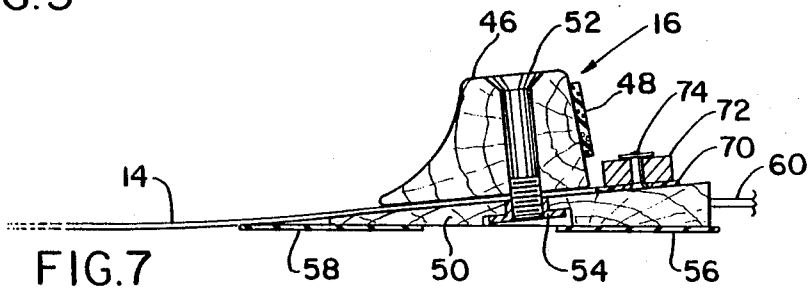
FIG. 7 is similarly a partial sectional view, but taken along line 6—6 of FIG. 3.

Outer end assembly 16 has a stop block 46 which is substantially similar to stop block 28, including a like foam rubber strip 48 and a foot-contacting concave surface similar to surface 45 on block 28. Block 46 is also connected to its respective base plate 50 by two flat head Allen screws 52. Like assembly 12, assembly 16 has flange nuts 54 that are counterbored in plate 50 to receive screws 52. In assembly 16, slide body 14 is similarly sandwiched between block 46 and plate 50. Slide body 14 at the end depicted in FIG. 7 is not attached to base plate 50, as it is in assembly 12. This is done intentionally to allow for adjusting the position of outer assembly 16 relative to inner assembly 12 which, in turn, determines the active length of upper surface 18, as may be more readily understood by a comparison of FIGS. 7 and 8. Body 14 becomes clamped between block 46 and plate 50 only when screws 52 are applied and tightened.

Figure 8:
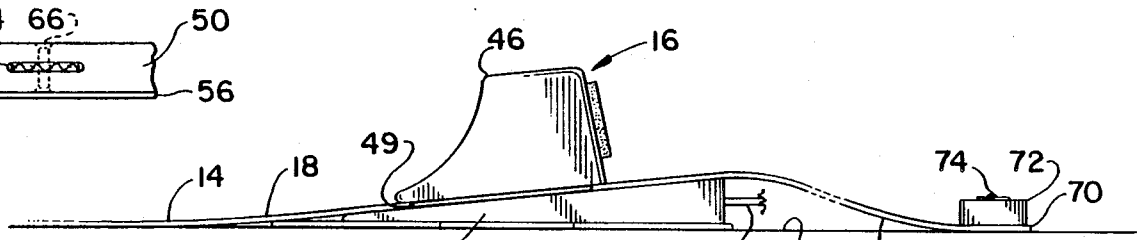
FIG. 8 is a partial front elevational view, similar to FIG. 7, but illustrating, by comparison with FIG. 7, how an outer end assembly can be relocated on the sliding surface component of the slide board.

On the right longitudinal side 70 of the rectangular slide body 14, as viewed in FIGS. 5 and 7, there is a weight bar 72 to counteract the tendency of the peripheral edge of the slide body 14 to coil inwardly when the outer end assembly 16 is adjusted inwardly to the position depicted in FIG. 8.

Figure 9:
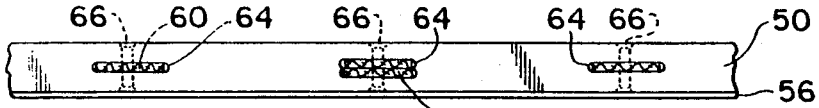
FIG. 9 is a sectional view as taken along line 9—9 of FIG. 3.

Base plate 50, like its counterpart base plate 26, is also made of wood, is wedge shaped in cross section, has a rubber strip 56 along its outer bottom edge and a rubber strip 58 along its inner edge. Strip 58 is also applied in overlapping relation but being in the outside helical turn does not require a groove similar to groove 40 in strip 46. Strips 34, 36, 56 and 58 serve as friction surfaces to counteract lateral forces which develop during ice skating stroking use of the slide board 10. Since base plate 50 is part of the outer end assembly 16, it is fitted with a handle 60 and a strap 62. As best seen in FIG. 9, strap 62 and handle 60, both made of sturdy webbing, are inserted in appropriate openings 64 within the body of base plate 50 and are secured therein by rivets 66. Although any one of several commercially available buckles such as that designated 68 can be used on strap 62, a two part, quick disconnect model SR-1 (not shown in detail) such as manufactured by Fastex, Des Plaines, Ill. has been used to advantage.

Figure 11:
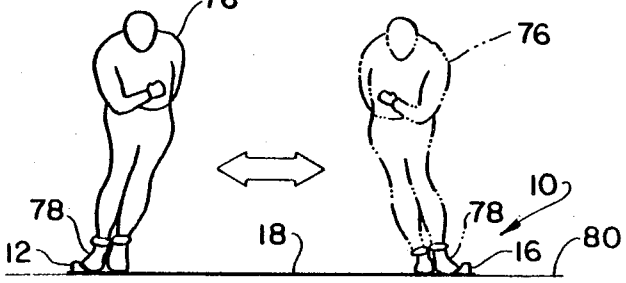
FIG. 11 is a simplified front elevational view in which a full line and phantom line perspective of an exerciser demonstrates a basic exercise routine on the within slide board.
Figure 10:
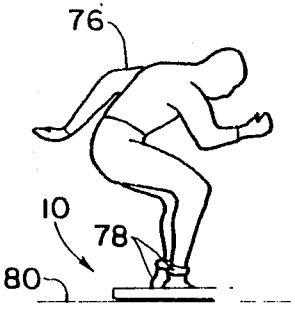
FIG. 10 is a simplified side elevational view demonstrating the slide board in use.

As best seen in FIGS. 10 and 11, the exerciser using the device 10 must don heavy socks. The support surface 80 for the device 10 is selected to be hard and not slippery, being preferably concrete. In setting up for practice and training, an appropriate adjustment is made of end assembly 16 relative to end assembly 12, and the exerciser 76 will then usually assume a crouched starting position as shown in FIG. 10. As seen next in FIG. 11, the exerciser 76 leans inboard, with the outboard foot against the appropriate stop assembly, and executes a pushing action which results in a sliding movement towards the opposite stop assembly. The action is then repeated with the other leg and the user returns to the original stop assembly, where the just described exercise cycle is continued. Grooves 20 in slide body 14 provide "tracking" so that user 76 does not slide forward or backward to the edge of surface 18 and are also helpful in countering the memory of the plastic to assume a coiled configuration. Performance of this exercise routine or cycle effectively simulates the lateral action of the speed skater or slalom racer. Variations of this basic routine involving arm movements and length of lateral stride are particularly instructive for ice skaters, but also have been found beneficial in training for other sports such as tennis and basketball where lateral movements of the participants are required.

Figure 12:
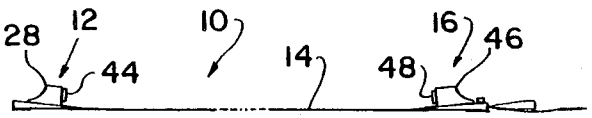
FIG. 12 is a view similar to FIG. 5, but on a reduced scale and showing the stop blocks of the end assemblies in a reversed position.

For some exercises, stop blocks 28 and 46 may be reversed, that is, the vertical sides with respective foam strips 44 or 48 may be made to face inboard as shown in FIG. 12, to provide training primarily in elementary, rather than a more advanced technique.

From the foregoing description it should be readily appreciated that the slideboard 10 provides a practice surface for simulating ice skating that is durable, portable and light weight, and constitutes exercise equipment of significant utility for the development of balance, coordination and overall muscular skill that is used in ice skating and is also used in many forms of recreation, dance and sports activity.

While the particular exercise apparatus herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. For performing side-to-side alternating sliding movements in an exercise routine on an exercise device comprising an elongated rectangular body of a plastic construction material for permitting the rolling thereof into helical turns upon itself, to thereby provide a compact storage condition to said exercise device when not in use and having a low friction surface for permitting said sliding movements thereon along the long dimension of said body, a cooperating pair of first and second sliding movement stop members attached in a transverse orientation and in spaced apart relation to each other to said body so as to bound therebetween an operative sliding area for said exercise routine, said first stop member being fixedly attached to said body adjacent one end thereof and said second stop member being movable into a selected position of movement therealong incident to the attachment thereof to said body so as to establish a permissible length of the sliding movements in said operative sliding area, a cooperating pair of wedges disposed in an interposed position between said body and said stop members such that each said first and said second stop member is clamped to a cooperating wedge in the attachment of said members to said body, and said stop members having concave surfaces in facing relation to each other such that said wedges and said concave surfaces cooperate to cause an ascending movement in the terminal portions of said sliding movements to thereby contribute to terminating the directional nature thereof and causing a reversal therein, and spaced apart indentations in said body low friction surface so as to form a pattern of lines oriented lengthwise thereof so as to frictionally oppose transverse sliding movement without impeding lengthwide sliding movement, to thereby contribute to the tracking of said sliding movements between said stop members.

* * * * *